US006496176B1

(12) United States Patent
Kondoh et al.

(10) Patent No.: US 6,496,176 B1
(45) Date of Patent: Dec. 17, 2002

(54) LIQUID CRYSTAL DEVICE AND METHOD FOR DRIVING THE SAME

(75) Inventors: Shinya Kondoh; Rintarou Takahashi, both of Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/355,036

(22) PCT Filed: Nov. 26, 1998

(86) PCT No.: PCT/JP98/05329

§ 371 (c)(1),
(2), (4) Date: Jul. 22, 1999

(87) PCT Pub. No.: WO99/30206

PCT Pub. Date: Jun. 17, 1999

(30) Foreign Application Priority Data

Dec. 5, 1997 (JP) ..... 9-334719

(51) Int. Cl.[7] ..... G09G 3/36
(52) U.S. Cl. ..... 345/101; 345/207
(58) Field of Search ..... 345/101, 147, 345/94, 207, 102, 104, 690, 691, 87, 88, 89; 349/72, 54; 348/658, 655

(56) References Cited

U.S. PATENT DOCUMENTS

| | | | | |
|---|---|---|---|---|
| 4,045,791 A | * | 8/1977 | Fukai et al. | 345/101 |
| 4,751,509 A | * | 6/1988 | Kubota et al. | 349/201 |
| 4,888,599 A | * | 12/1989 | Harwood et al. | 345/89 |
| 5,157,525 A | * | 10/1992 | Eaton et al. | 345/87 |
| 5,181,103 A | * | 1/1993 | Aoyama | 348/658 |
| 5,625,373 A | * | 4/1997 | Johnson | 345/58 |
| 5,786,801 A | * | 7/1998 | Ichise | 345/102 |

FOREIGN PATENT DOCUMENTS

| | | |
|---|---|---|
| EP | 0 772 140 | 5/1997 |
| JP | 5-5879 | 1/1993 |
| JP | 5-289043 | 11/1993 |
| JP | 5-297350 | 11/1993 |

OTHER PUBLICATIONS

Singh et al., "Accelerating Adobe Photoshop with Reconfigurable Logic," FPGAs for Custom Computing Machines, 1998, pp. 236–244, XP–010298165.
Cygnus Solutions: "eCos Reference Manual –Version 1.2.1"eCos Project Documentation, 'Online! May 17, 1999, XP–002192658.
Bursky, "Tool suite enables designers to craft customized embedded processors" Electonic Design, Feb. 8, 1999, Penton Publishing, USA 'Online! vol. 47, No. 3, XP–002192659.

* cited by examiner

*Primary Examiner*—Lun-Yi Lao
(74) *Attorney, Agent, or Firm*—Finnegan, Henderson, Farabow, Garrett & Dunner, L.L.P.

(57) ABSTRACT

A liquid crystal apparatus is provided which incorporates a means for automatically obtaining an optimum drive voltage value for a liquid crystal panel. Drive voltages are applied through a voltage value adjusting circuit (18) to scanning electrodes (17) and signal electrodes (16) provided in the liquid crystal panel (15), and a display is produced on the liquid crystal panel in accordance with the applied drive voltage waveforms. A display capture device (20), which comprises a CCD device (13) and a lens (14), captures an optimum display image from the liquid crystal panel and stores it in a reference memory (10). Further, the display capture device (20) captures a display produced on the liquid crystal panel and stores it in a capture memory (11). A display data difference circuit (12) compares the data stored in the capture memory (11) with the data stored in the reference memory (10) to determine whether they coincide or not and, based on the result of the comparison, an optimum voltage setting CPU (19) controls the voltage value adjusting circuit (18).

9 Claims, 11 Drawing Sheets

LIQUID CRYSTAL DEVICE AND METHOD FOR DRIVING THE SAME

TECHNICAL FIELD

The present invention relates to a liquid crystal apparatus. More particularly, the invention relates to a smectic liquid crystal apparatus, in particular to the configuration of such an apparatus and a method of driving the same wherein optimum drive voltage values are obtained automatically and the apparatus is driven with the thus obtained voltage values.

BACKGROUND ART

Research into and development of liquid crystal panels has been conducted actively in recent years because of their potential to be able to provide display quality comparable to that of CRTs despite their thin, light-weight, and compact construction. Nowadays, liquid crystal panels are used not only for television sets and computer monitors but also for so-called spatial light modulators such as optical shutters.

In liquid crystal materials used in liquid crystal panels, the threshold voltage at which the liquid crystal molecules switch from one state to another has temperature dependency. Furthermore, liquid crystal panels have viewing-angle dependency in that the visibility of the display varies depending on the viewing angle. Accordingly, liquid crystal apparatuses have usually been equipped with a device for adjusting the voltage applied to the liquid crystal so that optimum display can be produced in operation, and it has been practiced to adjust the voltage for optimum display while actually viewing the liquid crystal screen.

DISCLOSURE OF THE INVENTION

However, when using a liquid crystal panel as a spatial light modulator, since the liquid crystal panel is mounted inside the apparatus, the display condition of the liquid crystal panel cannot be checked directly by the human eye. In view of this, an object of the present invention is to provide a liquid crystal apparatus incorporating a configuration for automatically obtaining the drive voltage value necessary to drive the liquid crystal panel in an optimum display condition (i.e., the highest contrast condition) when the display condition of the liquid crystal panel cannot be checked directly by the human eye (such a drive voltage value is hereinafter referred to as the "optimum drive voltage value").

The liquid crystal apparatus of the present invention is used, among others, for a display apparatus or for a spatial light modulator used to adjust the light amount of a two-dimensional optical signal at very high speed. When the liquid crystal apparatus of the invention is used as a spatial light modulator, the liquid crystal panel acts as an optical shutter for forming the incident two-dimensional optical signal into an output light beam of a prescribed state.

The present invention is directed to a liquid crystal apparatus using a smectic liquid crystal such as a ferroelectric liquid crystal or an antiferroelectric liquid crystal.

To achieve the above object, the present invention provides the following configuration.

The liquid crystal apparatus of the present invention comprises: a liquid crystal panel constructed by sandwiching a smectic liquid crystal between a pair of substrates; a display capture device for capturing an image displayed on the liquid crystal panel; a capture memory for storing the captured image data; a reference memory for storing reference image data; a display difference circuit which compares the data stored in the capture memory with the data stored in the reference memory; a voltage value adjusting circuit for adjusting a voltage value for application to the liquid crystal panel; and an optimum voltage setting means.

The liquid crystal apparatus of the present invention also comprises a liquid crystal panel constructed by sandwiching a smectic liquid crystal between a pair of substrates respectively having a plurality of signal electrodes and scanning electrodes. In this configuration, the signal voltage to be applied to the signal electrodes and the scanning voltage to be applied to the scanning electrodes are respectively varied and, in each combination of the signal voltage and the scanning voltage, the display produced on the liquid crystal panel is captured by the display capture device. The captured image data is stored in the capture memory, and the thus captured image data is compared with the reference image data. Then, any combination of the signal voltage and the scanning voltage where the two data coincide is plotted as a coordinate point with the signal voltage along X axis and the scanning voltage along Y axis. The signal voltage value and scanning voltage value corresponding to the coordinates of the centroid of the region described by the plotted points are respectively set as the optimum drive voltage values.

Further, at the highest temperature and the lowest temperature in a temperature range where the liquid crystal apparatus is capable of operating, the same sequence of operations as described above is performed to obtain respectively plotted regions. The signal voltage value and scanning voltage value corresponding to the coordinates of the centroid of a region where the region described by the plotted points at the highest temperature overlaps the region described by the plotted points at the lowest temperature are respectively set as the optimum drive voltage values.

ADVANTAGEOUS EFFECT OF THE INVENTION

Using the liquid crystal apparatus of the present invention, optimum drive voltages can be set even when the display condition of the liquid crystal panel cannot be observed directly by the human eye. Further, by using the optimum drive voltages obtained by the above method, optimum display can be produced without having to adjust the drive voltages even if there occurs some degree of variation in the threshold voltage or the like of the liquid crystal due to temperature changes, etc.

DETAILED DESCRIPTION OF THE INVENTION

Figure 1:
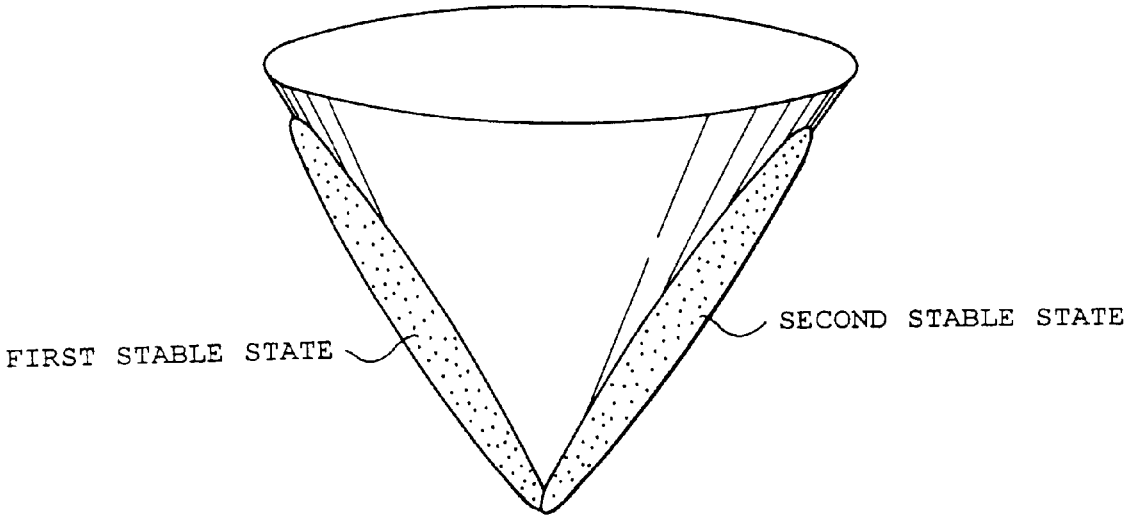
FIG. 1 is a diagram showing stable states of liquid crystal molecules in a ferroelectric liquid crystal.

FIG. 1 is a diagram showing a ferroelectric liquid crystal in a stable state. As shown in FIG. 1, the ferroelectric liquid crystal has two stable states, and switches into the first stable state or the second stable state, depending on the polarity of the applied voltage.

Figure 2:
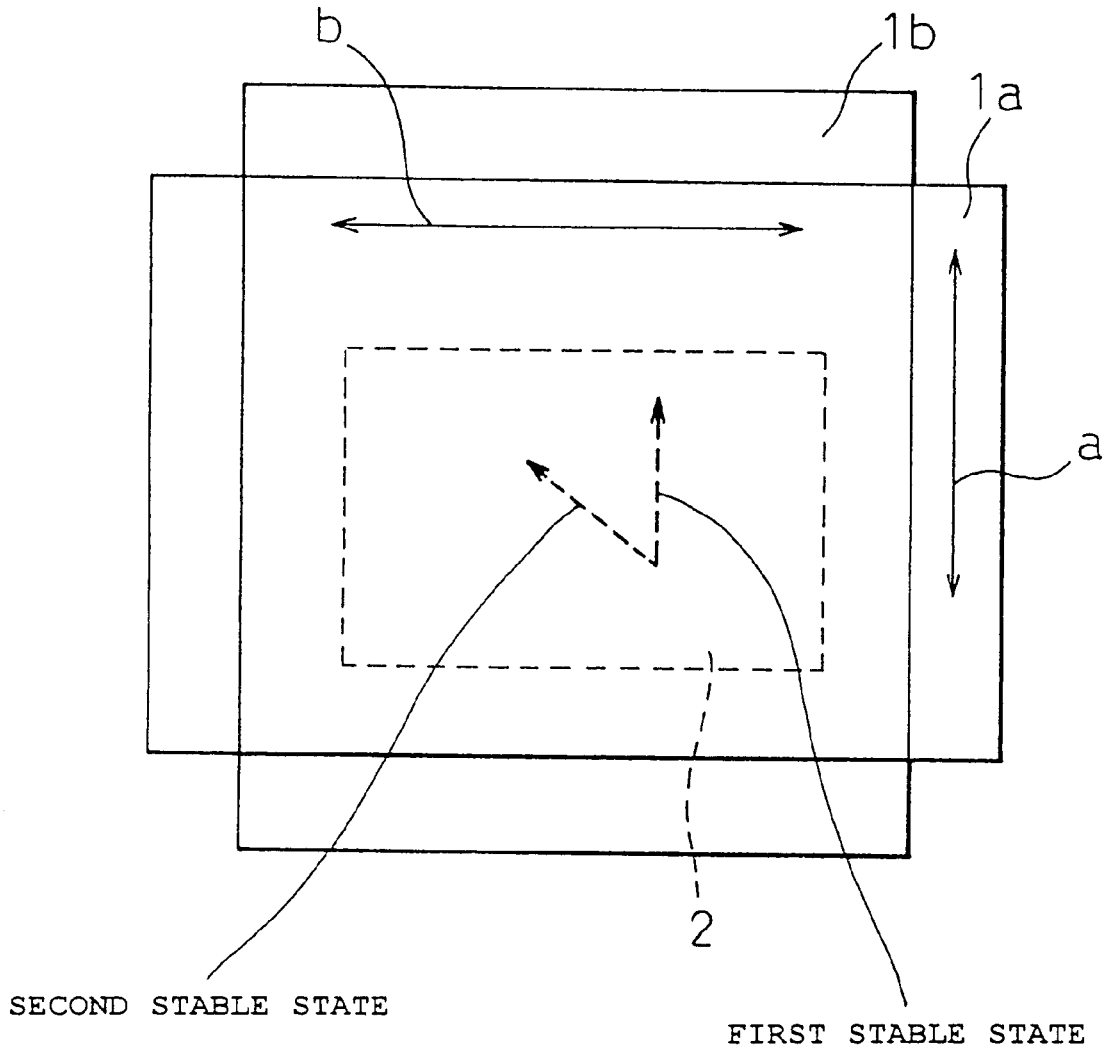
FIG. 2 is a diagram showing the arrangement of a ferroelectric liquid crystal cell and polarizers.

FIG. 2 is a diagram showing the arrangement of polarizers when the ferroelectric liquid crystal is used as a liquid crystal device. Between the polarizers 1*a* and 1*b* arranged in a crossed Nicol configuration is placed a liquid crystal cell 2 in such a manner that the long axis direction of liquid crystal molecules when the molecules are in the first stable state or in the second stable state is substantially parallel to either the polarization axis, a, of the polarizer 1*a* or the polarization axis, b, of the polarizer 1*b*.

Figure 3:
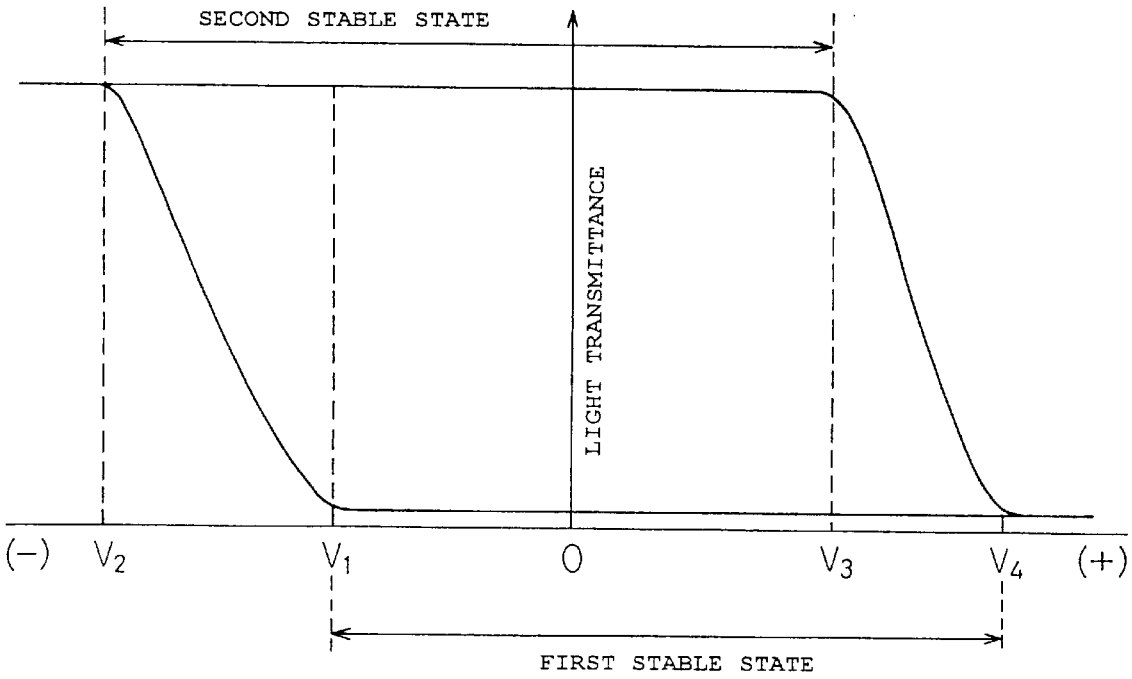
FIG. 3 is a diagram showing how the light transmittance of a ferroelectric liquid crystal device varies with an applied voltage.

When voltage is applied across the thus structured liquid crystal cell, its light transmittance varies with the applied voltage, describing a loop as plotted in the graph of FIG. 3. The voltage value at which the light transmittance begins to change, when a negative voltage is applied, is denoted by V1, and the voltage value at which the light transmittance reaches saturation is denoted by V2; on the other hand, when a voltage of opposite polarity is applied, the voltage value at which the light transmittance begins to drop is denoted by V3, and the voltage value at and beyond which the light transmittance does not drop further is denoted by V4. As shown in FIG. 3, the first stable state is obtained when the value of the applied voltage is greater than the threshold of the ferroelectric liquid crystal molecules. When the voltage of opposite polarity greater than the threshold of the ferroelectric liquid crystal molecules is applied, the second stable state is selected.

When the polarizers are arranged as shown in FIG. 2, a black display state (non-transmission state) can be achieved in the first stable state and a white display state (transmission state) in the second stable state. The arrangement of the polarizers can be changed so that a white display state (transmission state) is obtained in the first stable state and a black display state (non-transmission state) in the second stable state.

Figure 4:
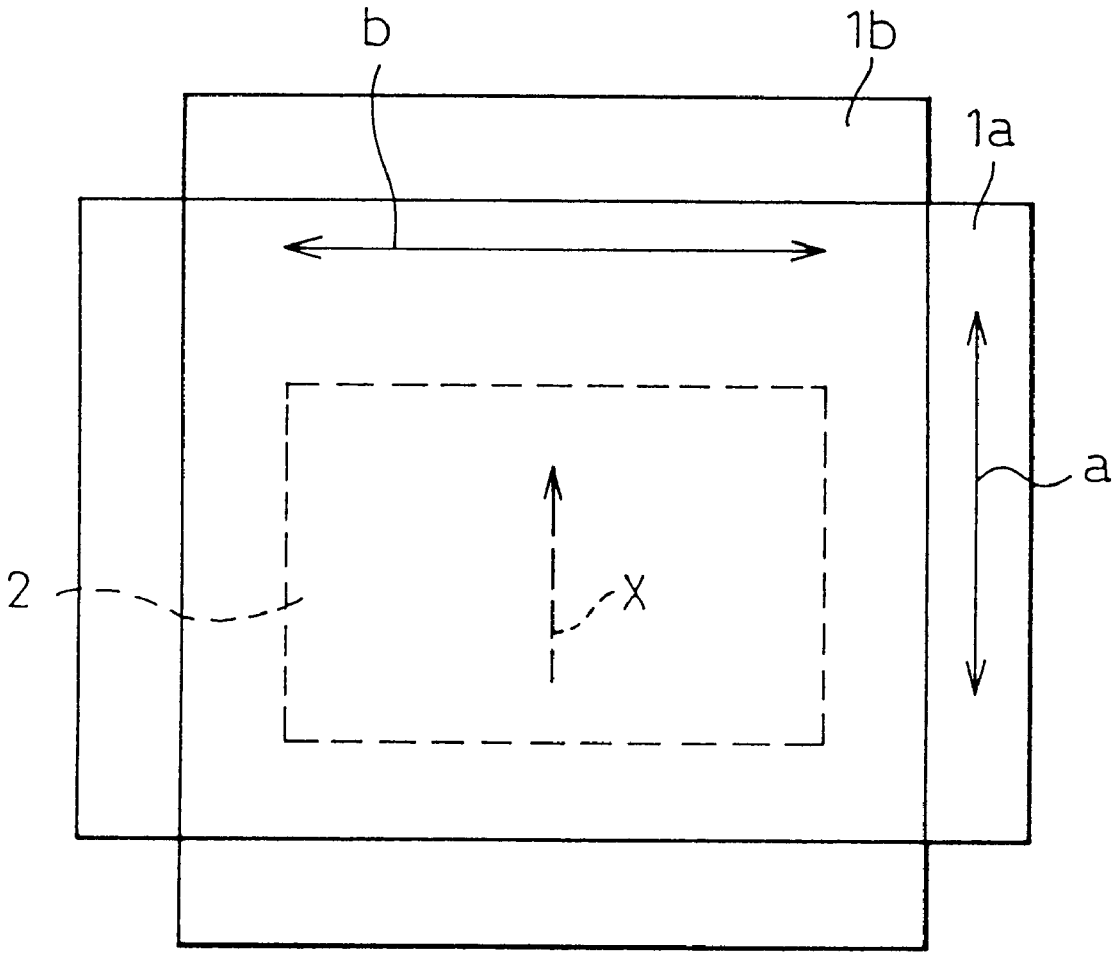
FIG. 4 is a diagram showing the arrangement of an antiferroelectric liquid crystal cell and polarizers.

FIG. 4 is a diagram showing the arrangement of polarizers when an antiferroelectric liquid crystal is used as a liquid crystal device. Between the polarizers 1*a* and 1*b* arranged in a crossed Nicol configuration is placed a liquid crystal cell 2 in such a manner that the average long axis direction X of molecules in the absence of an applied voltage is oriented substantially parallel to either the polarization axis, a, of the polarizer 1*a* or the polarization axis, b, of the polarizer 1*b*. Then, the liquid crystal cell is set up so that a black display state is obtained in the absence of an applied voltage and a white display state in the presence of an applied voltage.

Figure 5:
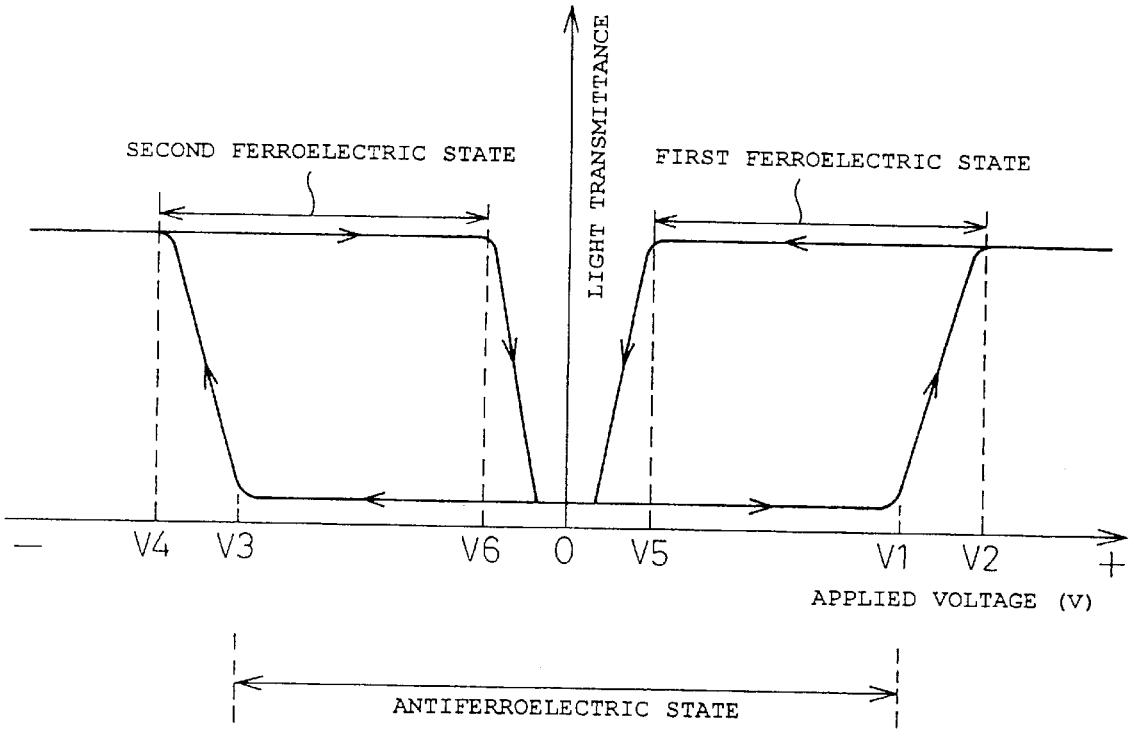
FIG. 5 is a diagram showing how the light transmittance of an antiferroelectric liquid crystal device varies with an applied voltage.

When voltage is applied across the thus structured liquid crystal cell, its light transmittance varies with the applied voltage, describing a loop as plotted in the graph of FIG. 5. The voltage value at which the light transmittance begins to change when the applied voltage is increased is denoted by V1, and the voltage value at which the light transmittance reaches saturation is denoted by V2, while the voltage value at which the light transmittance begins to drop when the applied voltage is decreased is denoted by V5; further, when a voltage of opposite polarity is applied, the voltage value at which the light transmittance begins to change when the absolute value of the applied voltage is increased is denoted by V3, and the voltage value at which the light transmittance reaches saturation is denoted by V4, while the voltage value at which the light transmittance begins to change when the absolute value of the applied voltage is decreased is denoted by V6. As shown in FIG. 5, a first ferroelectric state is selected when the value of the applied voltage is greater than the threshold of the antiferroelectric liquid crystal molecules. When the voltage of opposite polarity greater than the threshold of the antiferroelectric liquid crystal molecules is applied, a second ferroelectric state is selected. In either of these ferroelectric states, when the voltage value drops below a certain threshold, an antiferroelectric state is selected.

Figure 6:
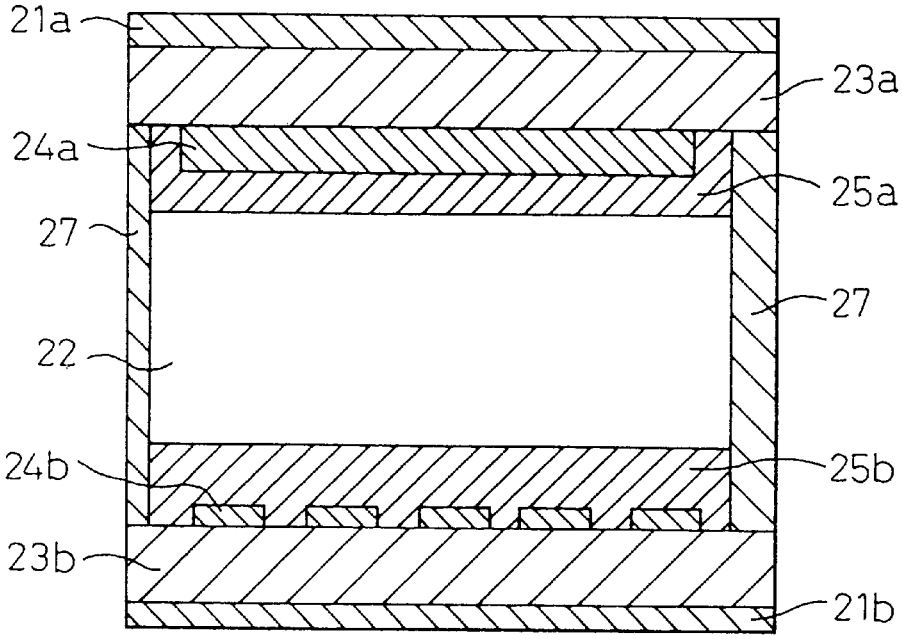
FIG. 6 is a diagram showing the structure of a liquid crystal panel used in the present invention.

The liquid crystal panel used in the present invention, shown in FIG. 6, comprises a pair of glass substrates 23*a* and 23*b* holding therebetween a ferroelectric liquid crystal layer or antiferroelectric liquid crystal layer 22 about 1.7 $\mu$m in thickness. On the opposing surfaces of the glass substrates are formed electrodes 24*a* and 24*b*, on top of which inorganic alignment films 25*a* and 25*b* are deposited. Further, a polarizer 21*a* is mounted on the outside surface of one glass substrate, while on the outside surface of the other glass substrate, a polarizer 21*b* is arranged with its polarization axis oriented at 90° to the polarization axis of the polarizer 21*a*.

When the liquid crystal apparatus of the present invention is mounted inside an optical control apparatus, the display condition of the liquid crystal panel cannot be observed visually from the outside. In view of this, the liquid crystal apparatus of the present invention incorporates a device for automatically setting the optimum drive voltage so that the liquid crystal panel can be driven in the optimum display condition. The term display here refers to the display of an image when the liquid crystal is used as a display device, as well as to the amount of transmitted light when the liquid crystal is used as a shutter or the like.

Figure 7:
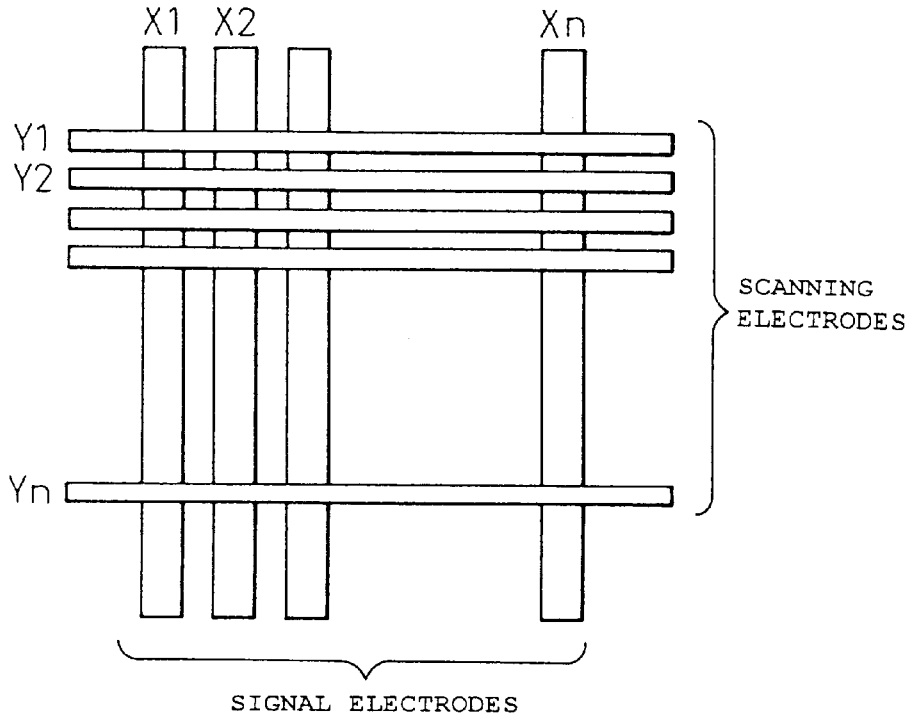
FIG. 7 is a diagram showing an example of the electrode arrangement in the liquid crystal panel used in the present invention.

FIG. 7 shows the electrode arrangement in the liquid crystal panel for matrix driving. Voltage waveforms are applied to the scanning electrodes (Y1 to Yn) and signal electrodes (X1 to Xn) to drive the liquid crystal. The state of the liquid crystal depends on the voltage values of the voltage waveforms applied to the respective electrodes.

Figure 8:
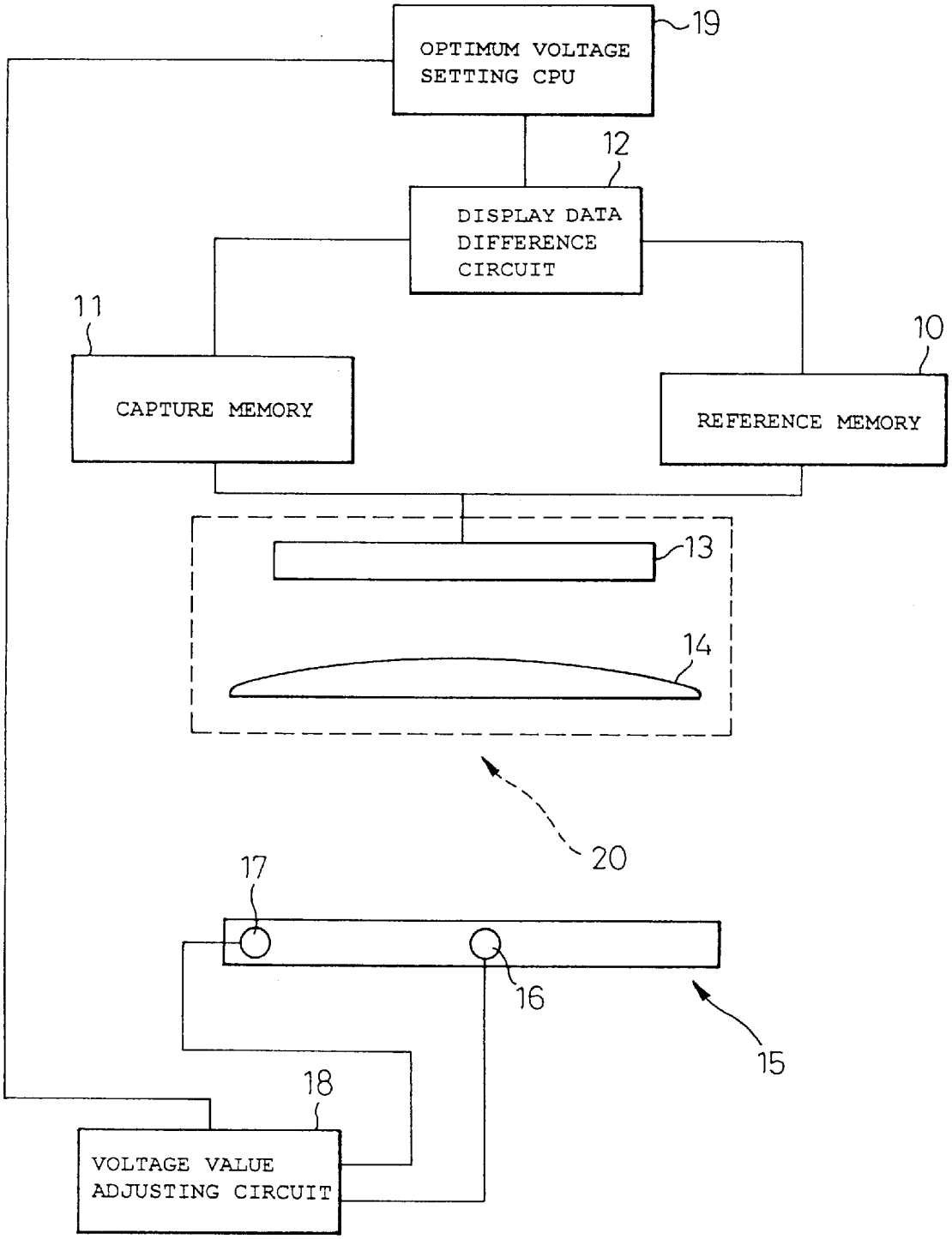
FIG. 8 is a block diagram of a liquid crystal apparatus according to the present invention incorporating an optimum drive voltage setting circuit.

FIG. 8 is a block diagram of the liquid crystal apparatus according to the present invention incorporating an optimum drive voltage setting circuit. The liquid crystal panel 15 includes signal electrodes 16 and scanning electrodes 17. Drive voltage waveforms are applied through a voltage value adjusting circuit 18 to these electrodes, and a display is produced on the liquid crystal panel in accordance with the applied drive voltage waveforms. A display capture device 20, which comprises a CCD device 13 and a lens 14, captures an optimum display image (described later) from the liquid crystal panel and stores it in a reference memory 10. The display capture device 20 also captures a sample display (described later) from the liquid crystal panel and stores it in a capture memory 11. A display data difference circuit 12 compares the data stored in the capture memory 11 with the data stored in the reference memory 10 to determine whether they coincide or not and, based on the result of the comparison, an optimum voltage setting CPU 19 controls the voltage value adjusting circuit 18.

Next, a description will be given of the operation of the liquid crystal apparatus according to the present invention incorporating the optimum drive voltage setting circuit shown in FIG. 8.

Figure 9:
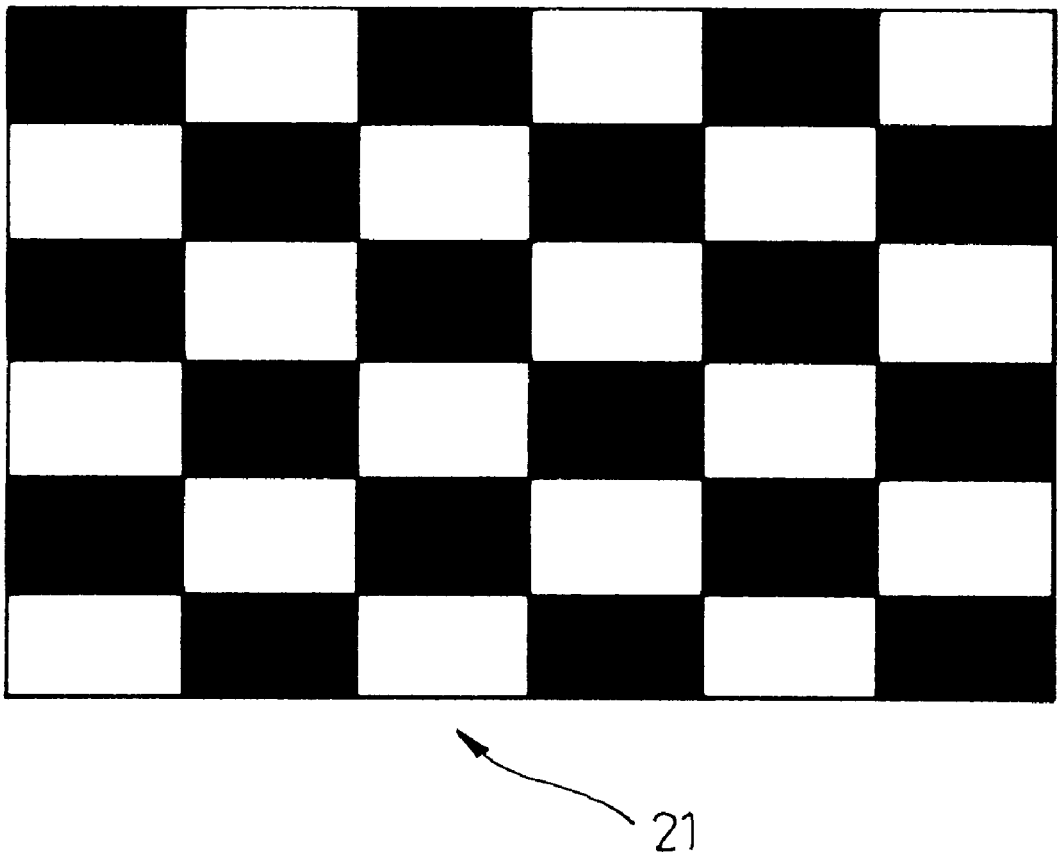
FIG. 9 is a diagram showing a sample display used in the present invention.

FIG. 9 is a diagram showing a sample display 21 consisting of a chequered pattern. Before the liquid crystal panel 15 is assembled, for example, into an optical control apparatus, the same pattern as the sample display 21 is displayed. While visually observing the displayed pattern, the voltages applied to the signal electrodes 16 and scanning electrodes 17 on the liquid crystal panel 15 are adjusted to obtain the optimum display image (hereinafter referred to as the "reference image"). This image is captured by the display capture device 20 which stores the captured reference image data in the reference memory 10.

Next, a description will be given of how the optimum drive voltage values are automatically obtained after the liquid crystal panel has been assembled into the optical control apparatus. The same pattern as the sample display 21 shown in FIG. 9 is displayed after assembling the liquid crystal panel into the optical control apparatus. The displayed image is then captured by the display capture device 20 which stores the captured image in the capture memory 11. Next, the display data difference circuit 12 determines whether the image data just stored in the capture memory 11 coincides with the reference data of the optimum display image stored in the reference memory 10.

The operation of the liquid crystal apparatus of the present invention will be described in a more specific manner with reference to FIG. 10. First, both the signal voltage and scanning voltage are set to 1 V. Then, the display produced on the liquid crystal panel 15 is captured by the display capture device 20, and the captured image data is stored in the capture memory 11. Next, the display data difference circuit 12 determines whether the image data just captured from the liquid crystal panel and stored in the capture memory 11 coincides with the reference image data stored in the reference memory 10. When they coincide, the point at which the signal voltage 1 V as abscissa and the scanning voltage 1 V as ordinate intersect is plotted in the graph shown in FIG. 10.

Next, while holding the signal voltage at 1 V, the scanning voltage is raised to 1.5 V. Then, the display produced on the liquid crystal panel 15 is captured by the image capture device 20, and the captured image data is stored in the capture memory 11, as is done in the above process. The display data difference circuit 12 then determines whether the image data of the liquid crystal panel just stored in the capture memory 11 coincides with the reference image data stored in the reference memory 10. When they coincide, the point at which the signal voltage 1 V as abscissa and the scanning voltage 1.5 V as ordinate intersect is plotted in the graph shown in FIG. 10. When they do not match, the point is not plotted. The above process is repeated by increasing the scanning voltage in increments of 0.5 V until it reaches 20 V.

Next, the signal voltage is set to 1.5 V, and the same process as described above is performed by initially setting the scanning voltage to 1 V and then increasing it in increments of 0.5 V. In the above process, both the signal voltage and scanning voltage are initially set to 1 V, and then increased in increments of 0.5 V. However, these values may be changed as appropriate.

Figure 10:
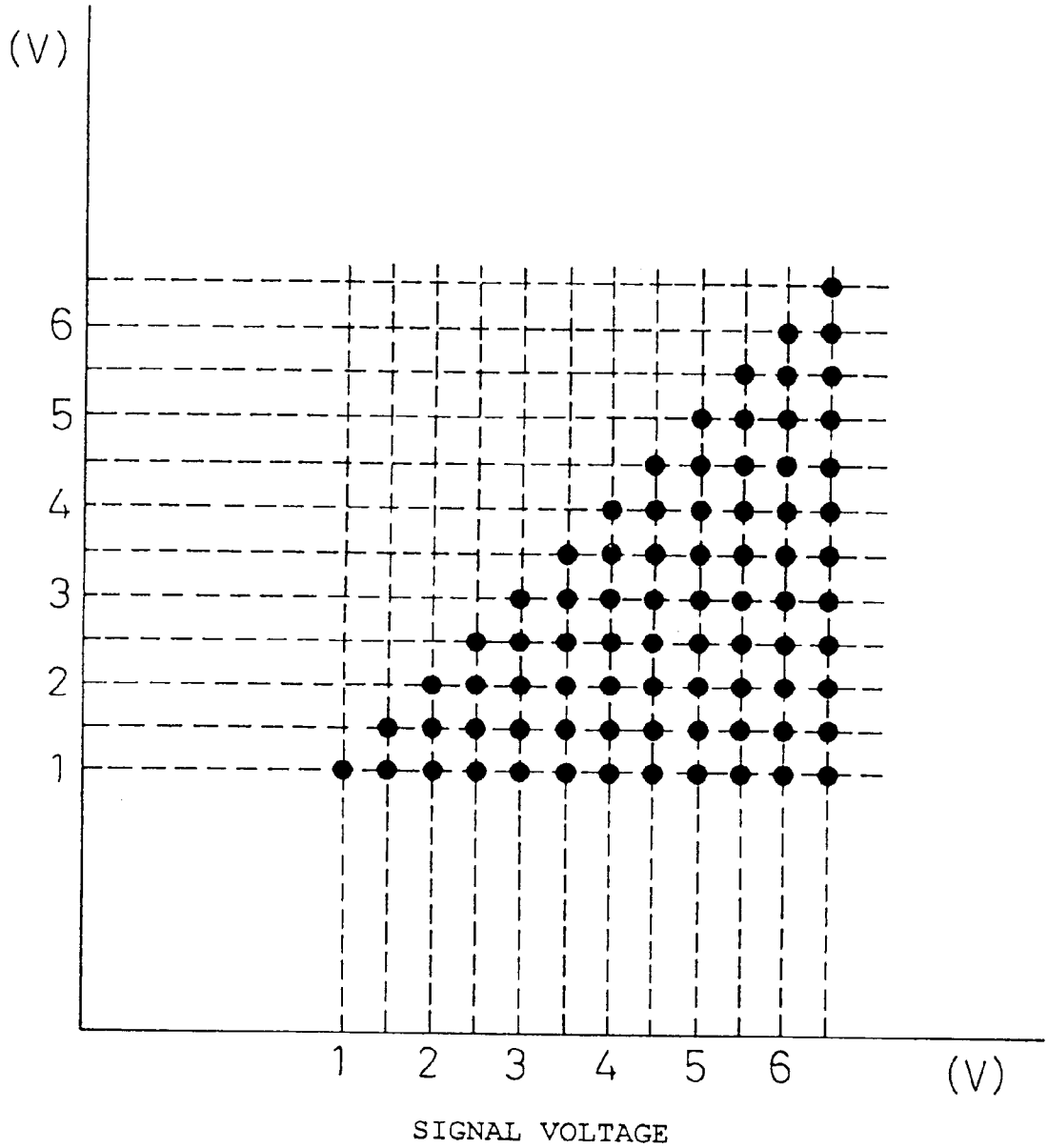
FIG. 10 is a diagram showing a drivable voltage value region for the liquid crystal panel used in the present invention.

By performing the above process, the point at which the scanning voltage value and the signal voltage value intersect is plotted in the graph whenever the two image data coincide; the result is shown in FIG. 10. As shown in FIG. 10, the region where the points are plotted is triangle in shape (this triangle region is hereinafter referred to as the "drivable region"). Then, the centroid of this "drivable region" is obtained, and the signal voltage and scanning voltage corresponding to the position of the centroid are used as the "optimum drive voltage values". When the signal voltage and scanning voltage corresponding to the position of the centroid are used as the optimum drive voltage values, if there occurs some degree of variation in the scanning voltage or signal voltage, the resulting voltage values always fall within the rectangular region that can achieve optimum driving. Accordingly, even when the liquid crystal drive voltage values have varied to a certain degree due to temperature changes, etc. the voltage values can still be used as the drive voltage values that can achieve optimum display.

The above sequence of operations for obtaining the optimum drive voltage values is controlled by the optimum voltage setting CPU 19 of FIG. 8.

When the liquid crystal apparatus is expected to be used in an environment subjected to large temperature variations, the drivable region is obtained at each of the lowest temperature and the highest temperature in the expected temperature range; then, the centroid of the rectangular region where the respective drivable regions overlap is obtained, and the signal voltage and scanning voltage corresponding to the position of the centroid of this rectangular region are used as the optimum drive voltage values.

Figure 11:
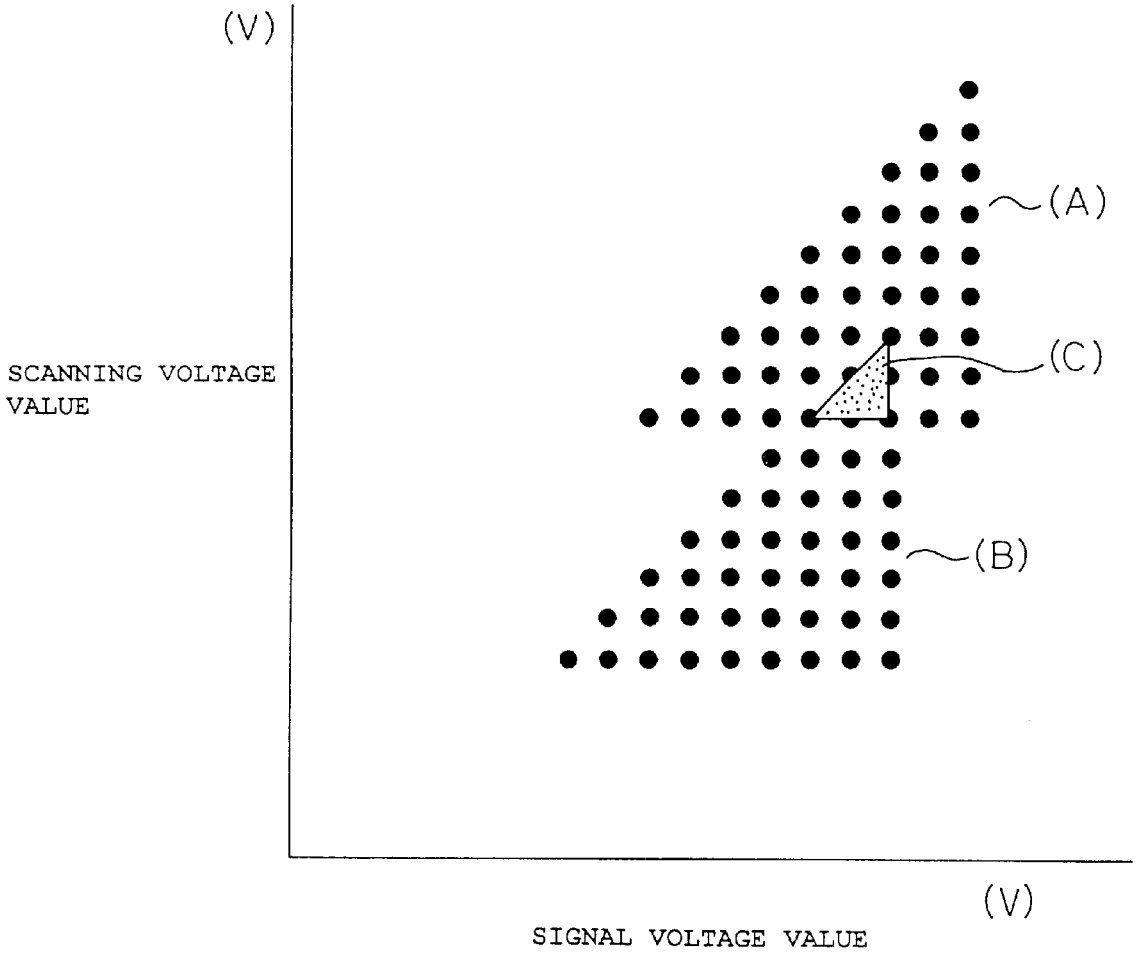
FIG. 11 is a diagram showing drivable voltage value regions at 35° C. and 45° C., respectively, for the liquid crystal panel used in the present invention.

FIG. 11 shows the triangle region obtained as described above. At the lowest temperature expected in the operating environment, for example, at 35° C., the triangle region (A) is obtained in the same manner as earlier described. Similarly, the triangle region (B) is obtained at the highest temperature expected in the operating environment, for example, at 45° C. Then, the centroid of the triangle region (C) where the triangle regions (A) and (B) overlap is obtained, and the signal voltage and scanning voltage corresponding to the position of the centroid are used as the "optimum drive voltage values". Using the thus determined "optimum drive voltage values", stable display can be produced within the range of 35° C. to 45° C. without having to correct the drive voltage values.

Figure 12:
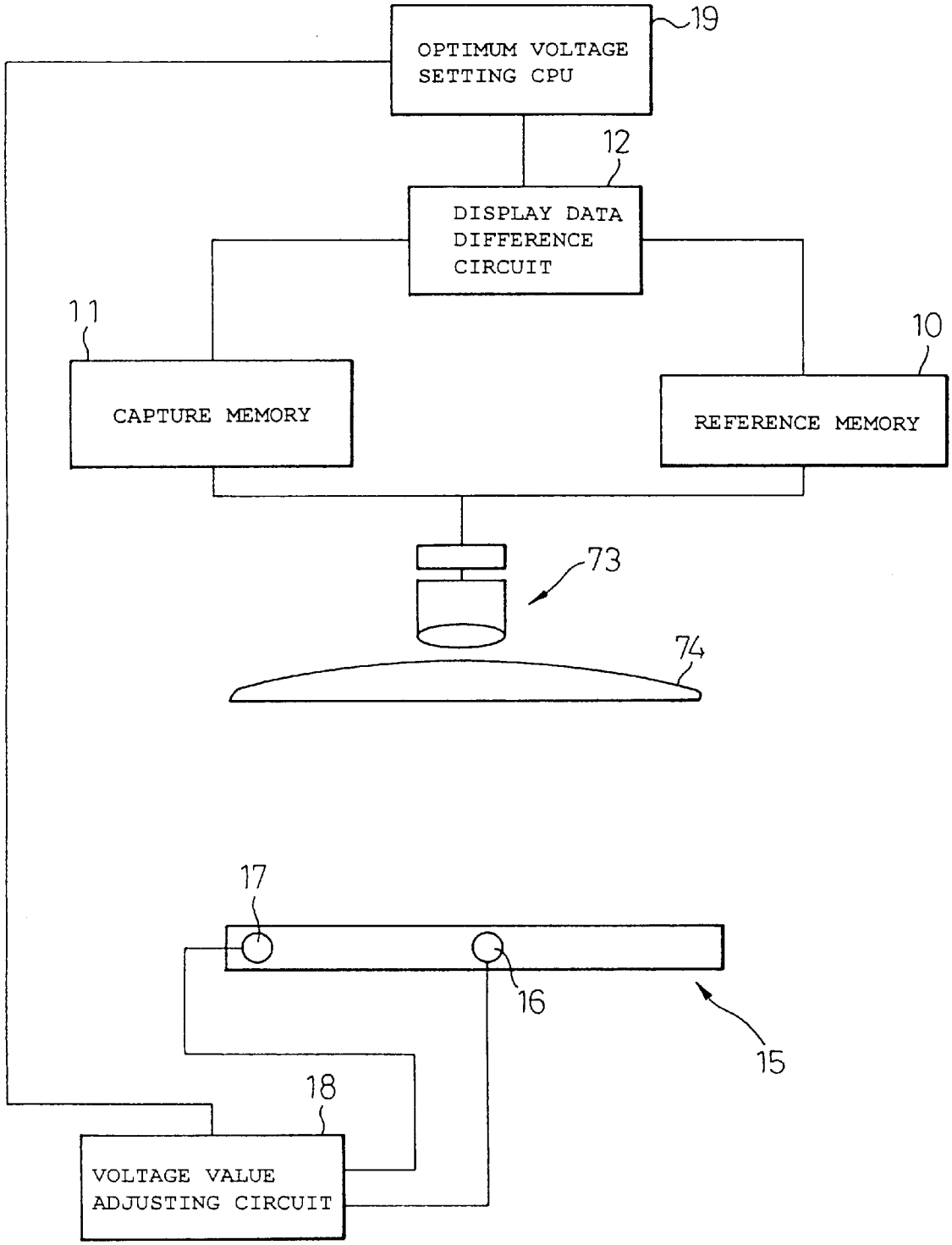
FIG. 12 is a block diagram of a liquid crystal apparatus according to another embodiment of the present invention incorporating an optimum drive voltage setting circuit.

The above embodiment has been described, dealing with the case in which the image data is directly captured by the display capture device 20 comprising the CCD device 13 and lens 14. As an alternative embodiment, as shown in FIG. 12, the display capture device may be replaced by a lens 74 for converging the transmitted light flux and a transmitted light amount measuring device 73 (consisting, for example, of a photodiode and an amplifier) for measuring the amount of light by receiving the converged light flux. In this configuration, the amount of light transmitted through the entire liquid crystal panel on which an image is displayed is captured. The transmitted light amount measuring device 73 captures the amount of transmitted light from the reference image displayed as the optimum display image, and stores the transmitted light amount data in the reference memory 10. Further, the transmitted light amount measuring device 73 captures the amount of transmitted light from the sample display produced on the liquid crystal panel, and stores it in the capture memory 11. Then, the display data difference circuit 12 determines whether the data just stored in the capture memory 11 coincides with the data stored in the reference memory 10 and, based on the result of the determination, the optimum voltage setting CPU 19 controls the voltage value adjusting circuit 18. In this embodiment, not only can the same effect as achieved in the embodiment shown in FIG. 8 be obtained, but the construction can be made simple compared with the configuration using the CCD device.

The embodiments of the present invention shown in FIGS. 8 and 12 have been described, dealing with a liquid crystal apparatus using a passive matrix technique. It will, however, be appreciated that the present invention is equally applicable to a liquid crystal apparatus using an active matrix technique.

What is claimed is:

1. A method of driving a liquid crystal apparatus including:

a liquid crystal panel constructed by sandwiching a liquid crystal between a pair of substrates respectively having a plurality of scanning electrodes and signal electrodes; a display capture device for capturing an image displayed on said liquid crystal panel; a capture memory for storing captured image data; a reference memory for storing reference image data; a display data difference circuit which compares the data stored in said capture memory with the data stored in said reference memory; a voltage value adjusting circuit for adjusting voltage values for application to said scanning electrodes and said signal electrodes; and an optimum voltage setting means, and wherein: said optimum voltage setting means applies optimum drive voltage values to said scanning electrodes and said signal electrodes, respectively, based on data obtained from said display data difference circuit;

the method comprising:

varying, in said liquid crystal apparatus, a signal voltage to be applied to said signal electrodes and a scanning voltage to be applied to said scanning electrodes respectively, for each combination of said signal voltage and said scanning voltage, capturing the display produced on said liquid crystal panel by said display capture device, storing said captured image data in said capture memory, comparing said captured image data with said reference image data, plotting any combination of said signal voltage and said scanning voltage where said two data coincide as a coordinate point with said signal voltage along X axis and said scanning voltage along Y axis, and setting a signal voltage value and scanning voltage value corresponding to the coordinates of the centroid of the region described by said plotted points as the optimum drive voltage values.

2. A method of driving a liquid crystal apparatus including:

a liquid crystal panel constructed by sandwiching a liquid crystal between a pair of substrates respectively having a plurality of scanning electrodes and signal electrodes; a display capture device for capturing an image displayed on said liquid crystal panel; a capture memory for storing captured image data; a reference memory for storing reference image data; a display data difference circuit which compares the data stored in said capture memory with the data stored in said reference memory; a voltage value adjusting circuit for adjusting voltage values for application to said scanning electrodes and said signal electrodes; and an optimum voltage setting means, and wherein said optimum voltage setting means applies optimum drive voltage values to said scanning electrodes and said signal electrodes, respectively, based on data obtained from said display data difference circuit;

the method comprising:

varying, at the highest temperature and the lowest temperature in a temperature range where said liquid crystal apparatus is operational, a signal voltage to be applied to said signal electrodes and a scanning voltage to be applied to said scanning electrodes, capturing, by said display capture device, for each combination of said signal voltage and said scanning voltage, the display produced on said liquid crystal, storing said captured image data in said capture memory, comparing said captured image data with said reference image data, plotting any combination of said signal voltage and said scanning voltage where said two data coincide as a coordinate point with said signal voltage along X axis and said scanning voltage along Y axis, and setting a signal voltage value and scanning voltage value, corresponding to the coordinates of the centroid of a region where the region described by the plotted points at said highest temperature overlaps the region described by the plotted points at said lowest temperature, as the optimum drive voltage values.

3. A method of driving a liquid crystal apparatus including:

a liquid crystal panel constructed by sandwiching a liquid crystal between a pair of substrates respectively having a plurality of scanning electrodes and signal electrodes; a transmitted light amount measuring device for measuring the amount of light transmitted through said liquid crystal panel; a capture memory for storing data of said transmitted light amount; a reference memory for storing transmitted light amount data of a reference image; a display data difference circuit which compares the data stored in said capture memory with the data stored in said reference memory; a voltage value adjusting circuit for adjusting voltage values for application to said scanning electrodes and signal electrodes; and an optimum voltage setting means, and wherein said optimum voltage setting means applies optimum drive voltage values to said scanning electrodes and signal electrodes, respectively, based on data obtained from said display data difference circuit;

the method comprising:

varying in said liquid crystal apparatus, a signal voltage to be applied to said signal electrodes and a scanning voltage to be applied to said scanning electrodes respectively, capturing by said transmitted light amount measuring device, for each combination of said signal voltage and said scanning voltage, the amount of light transmitted through said liquid crystal panel, storing said captured transmitted light amount data in said capture memory, comparing said captured transmitted light amount data with the transmitted light amount data of said reference image, plotting any combination of said signal voltage and said scanning voltage where said two data coincide as a coordinate point with said signal voltage along X axis and said scanning voltage along Y axis, and setting a signal voltage value and scanning voltage value corresponding to the coordinates of the centroid of the region described by said plotted points as the optimum drive voltage values.

4. A method of driving a liquid crystal apparatus including:

a liquid crystal panel constructed by sandwiching a liquid crystal between a pair of substrates respectively having a plurality of scanning electrodes and signal electrodes; a transmitted light amount measuring device for measuring the amount of light transmitted through said liquid crystal panel; a capture memory for storing data of said transmitted light amount; a reference memory for storing transmitted light amount data of a reference image; a display data difference circuit which compares the data stored in said capture memory with the data stored in said reference memory; a voltage value adjusting circuit for adjusting voltage values for application to said scanning electrodes and signal electrodes; and an optimum voltage setting means, and wherein said optimum voltage setting means applies optimum drive voltage values to said scanning electrodes and signal electrodes, respectively, based on data obtained from said display data difference circuit;

the method comprising:

varying, at the highest temperature and the lowest temperature in a temperature range where said liquid crystal apparatus is operational, a signal voltage to be applied to said signal electrodes and a scanning voltage to be applied to said scanning electrodes respectively, measuring by said transmitted light amount measuring device, for each combination of said signal voltage and said scanning voltage, the amount of light transmitted through said liquid crystal panel, storing said transmitted light amount data in said capture memory, comparing said captured transmitted light amount data with the transmitted light amount data of said reference image, plotting any combination of said signal voltage and said scanning voltage where said two data coincide as a coordinate point with said signal voltage along the X axis and said scanning voltage along the Y axis, and setting a signal voltage value and scanning voltage value corresponding to the coordinates of the centroid of a region where the region described by the plotted points at said highest temperature overlaps the region described by the plotted points at said lowest temperature, as the optimum drive voltage values.

5. A method of driving a liquid crystal apparatus including:

a liquid crystal panel constructed by sandwiching a liquid crystal between a pair of substrates and having a plurality of scanning electrodes and signal electrodes, and a display capture device for capturing an image displayed on the liquid crystal panel;

the method comprising the steps of:

varying a signal voltage to be applied to the signal electrodes and a scanning voltage to be applied to the scanning electrodes respectively, capturing the display, by the display capture device, produced on the liquid crystal panel for each combination of the signal voltage and the scanning voltage, comparing the captured image data with reference image data, plotting the combination of the signal voltage and the scanning voltage where the two data coincide, with the signal voltage along X axis and the scanning voltage along Y axis, and setting a signal voltage value and a scanning voltage value, corresponding to the coordinates of the centroid of the region described by the plotted points, as the optimum drive voltage value.

6. A method of driving a liquid crystal apparatus including:

a liquid crystal panel constructed by sandwiching a liquid crystal between a pair of substrates and having a plurality of scanning electrodes and signal electrodes, and a display capture device for capturing an image displayed on the liquid crystal panel;

the method comprising the steps of:

varying a signal voltage to be applied to the signal electrodes and a scanning voltage to be applied to the scanning electrodes respectively, at the highest temperature and the lowest temperature in a temperature range in which the liquid crystal apparatus is operational, capturing the display, by the display capture device, produced on the liquid crystal panel for each combination of the signal voltage and the scanning voltage, comparing the captured image data with reference image data, plotting the combination of the signal voltage and the scanning voltage where the two data coincide, with the signal voltage along X axis and the scanning voltage along Y axis, and setting a signal voltage value and a scanning voltage value, corresponding to the coordinates of the centroid of a region which overlaps between the region described by the plotted points at the highest temperature and the region described by the plotted points at the lowest temperature, as the optimum drive voltage value.

7. A method of driving a liquid crystal apparatus including a liquid crystal panel constructed by sandwiching a liquid crystal between a pair of substrates and having a plurality of scanning electrodes and signal electrodes;

the method comprising the steps of:

varying a signal voltage to be applied to the signal electrodes and a scanning voltage to be applied to the scanning electrodes respectively, measuring an amount of light transmitted through the liquid crystal panel for each combination of the signal voltage and the scanning voltage, as the transmitted light amount data, comparing the transmitted light amount data with reference image data, plotting as points on coordinates any combination of the signal voltage and the scanning voltage where the two data coincide, with the signal voltage along X axis and the scanning voltage along Y axis, and setting a signal voltage value and a scanning voltage value, corresponding to the coordinates of the centroid of a region described by the plotted points, as the optimum drive voltage value.

8. A method of driving a liquid crystal apparatus including a liquid crystal panel constructed by sandwiching a liquid crystal between a pair of substrates and having a plurality of scanning electrodes and signal electrodes;

the method comprising the steps of:

varying a signal voltage to be applied to the signal electrodes and a scanning voltage to be applied to the scanning electrodes respectively, at the highest temperature and the lowest temperature in a temperature range in which the liquid crystal apparatus is operational, measuring an amount of light transmitted through the liquid crystal panel for each combination of the signal voltage and the scanning voltage, as the transmitted light amount data, comparing the transmitted light amount data with reference image data, plotting the combination of the signal voltage and the scanning voltage where the two data coincide, with the signal voltage along X axis and the scanning voltage along Y axis, and setting a signal voltage value and a scanning voltage value, corresponding to the coordinates of the centroid of a region which overlaps between the region described by the plotted points at the highest temperature and the region described by the plotted points at the lowest temperature, as the optimum drive voltage value.

9. The method of driving a liquid crystal apparatus of any one of claims 1–8, wherein the liquid crystal is a smectic liquid crystal.

* * * * *